US007481749B1

(12) United States Patent
Chen

(10) Patent No.: US 7,481,749 B1
(45) Date of Patent: Jan. 27, 2009

(54) BODY-TRAINING BICYCLE

(76) Inventor: Chao-Chuan Chen, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/853,027

(22) Filed: Sep. 11, 2007

(51) Int. Cl.
*A63B 22/06* (2006.01)

(52) U.S. Cl. ..... 482/64; 482/57

(58) Field of Classification Search ..... 482/57, 482/64

See application file for complete search history.

(56) References Cited

U.S. PATENT DOCUMENTS 5,451,070 A * 9/1995 Lindsay et al. ..... 280/252
6,234,938 B1 * 5/2001 Chen ..... 482/57
6,475,122 B2 * 11/2002 Wu ..... 482/57
2004/0067822 A1 * 4/2004 Sher ..... 482/57

* cited by examiner

*Primary Examiner*—Lori Amerson

(57) ABSTRACT

A body-training bicycle comprises: a seat has a long central rod; a driving portion having a treading portion, a driving wheel connected to at least one treadle, a flywheel and a driving belt; the rotation of the flywheel will make the power generator generating power; an electric control portion having a control panel, a battery unit, a magnetic resisting unit, a displacement controller, and electric wires; the battery unit serving to store power from the flywheel; the magnetic coil set being installed aside a wheel periphery of the flywheel and the central shaft of the flywheel; the magnetic cell set controller serving to control the movement of the magnetic resisting unit to move closer or away from the flywheel; electric wires being installed between the power generator and the control panel and between the power generator and the battery unit.

6 Claims, 4 Drawing Sheets

BODY-TRAINING BICYCLE

FIELD OF THE INVENTION

The present invention relates to bicycles, and particularly to a body-training bicycle, wherein not only having the effect of exercising and body building, but also it has the effect of power storage. No external power is necessary. Moreover, the tension of the flywheel of the present invention is controllable through a magnetic resisting unit.

BACKGROUND OF THE INVENTION

The prior art body-training bicycle has a base. The base has a positioning plate. A magnetic wheel is installed on the plate. The user can drive the wheel to rotate. The positioning plate is installed with a coil panel having a plurality of coils which are arranged annularly. The rotation of the wheel will induce the coil to generate power. One end of each coil is connected to an electric wire. The wire is connected to an electric device.

The defect of the prior art is that no control panel is installed and furthermore no battery unit is installed for storing power. Thus the effect is limited.

SUMMARY OF THE INVENTION

Accordingly, the primary object of the present invention is to provide a body-training bicycle, wherein not only having the effect of exercising, and body building, but also it has the effect of power storage. No external power is necessary. Moreover, the tension of the flywheel of the present invention is controllable through a magnetic resisting unit.

To achieve above objects, the present invention provides a body-training bicycle, comprising: a seat has a long central rod; a driving portion having a treading portion, a driving wheel connected to at least one treadle, a flywheel and a driving belt; the flywheel being installed upon the seat; one side the flywheel being installed with a power generator; the rotation of the flywheel will make the power generator generating power; the driving belt encircling around a center shaft of the flywheel and the driving wheel so that the rotation of the driving wheel 42 will make the flywheel rotates and thus the power generator generates electric power; an electric control portion having a control panel, a battery unit, a magnetic resisting unit, a displacement controller, and a first electric wire and a second electric wire; the battery unit serving to store power from the flywheel; the magnetic coil set being installed aside a wheel periphery of the flywheel and the central shaft of the flywheel; the magnetic cell set controller serving to control the movement of the magnetic resisting unit to move closer or away from the flywheel; the first electric wire being installed between the power generator and the control panel; the second electric wire being installed between the power generator and the battery unit.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
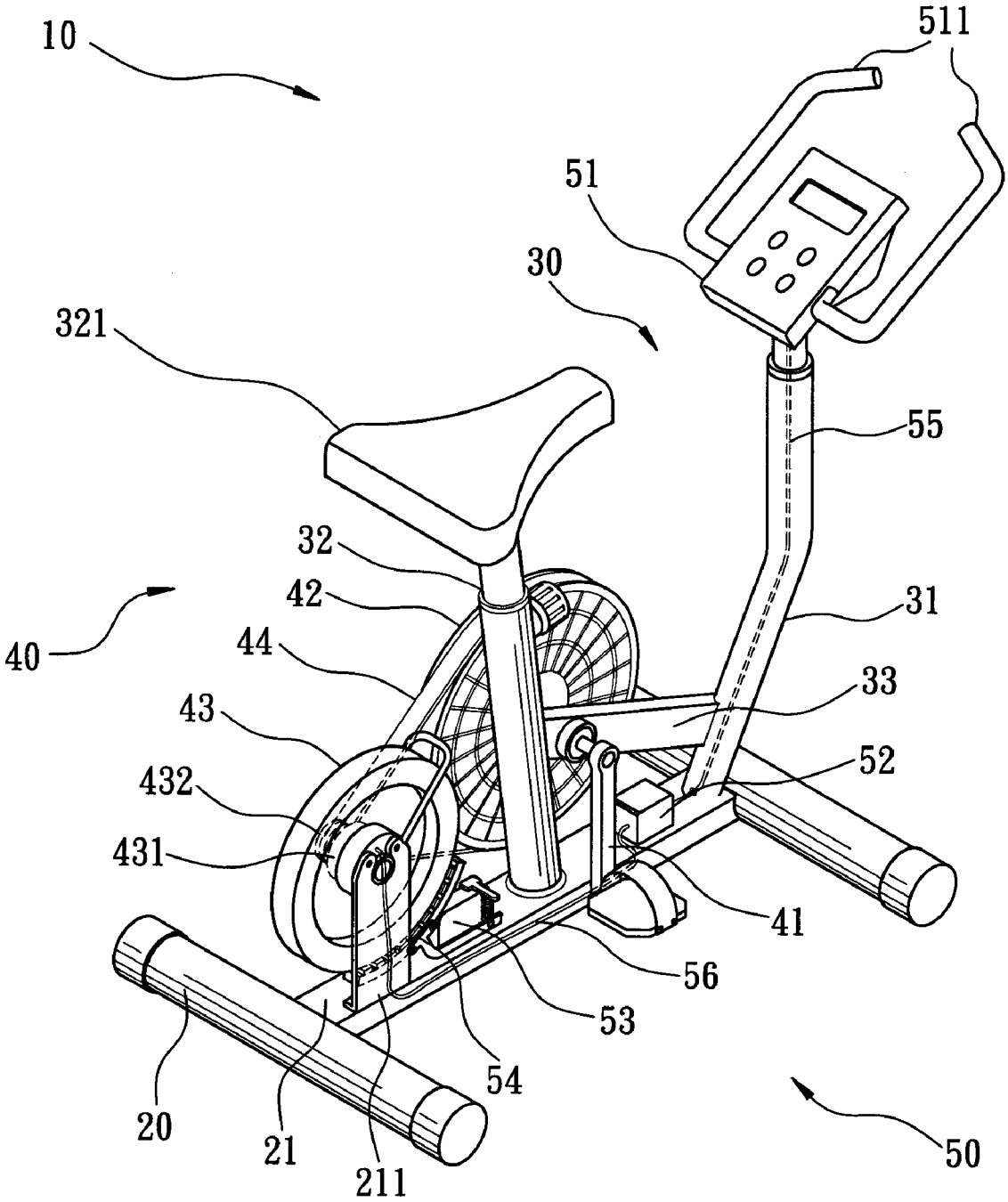
FIG. 1 is a schematic perspective view of the body-training bicycle of the present invention.

With reference to FIG. 1, the body-training bicycle of the present invention is illustrated. The present invention has the following elements.

An H shape seat 20 has a long central rod 21. A rear end of the central rod 21 is formed as a wheel base 211.

A supporting assembly 30 has a supporting rod 31, a seat rod 32 and a middle rod 33. One end of the seat rod 32 is connected to a middle section of the central rod 21 of the seat 20 and is inclined backwards slightly. Another end of the seat rod 32 is connected with a cushion 321. The supporting rod 31 has a V shape. One end of the seat rod 32 is formed at a front end of the central rod 21 of the seat 20 and the seat rod 32 is inclined forwards slightly. One end of the middle rod 33 is formed at a middle part of the seat rod 32 and another end is formed at a lower end of the supporting rod 31.

A driving portion 40 has a treading portion 41, a driving wheel 42, a flywheel 43 and a driving belt 44. The treading portion 41 is at two sides of the middle rod 33. The driving wheel 42 is installed aside the middle rod 33. The center of the driving wheel 42 is connected to the treading portion 41 so that the movement of the treading portion 41 will drive the driving wheel 42. The flywheel 43 is installed upon the wheel base 211 of the seat 20. One side the flywheel 43 is installed with a power generator 431. The rotation of the flywheel 43 will make the power generator 431 generating power. The driving belt 44 encircles around a center shaft of the flywheel 43 and the driving wheel 42 so that the rotation of the driving wheel 42 will make the flywheel 43 rotates and thus the power generator 431 generates electric power.

Figure 2:
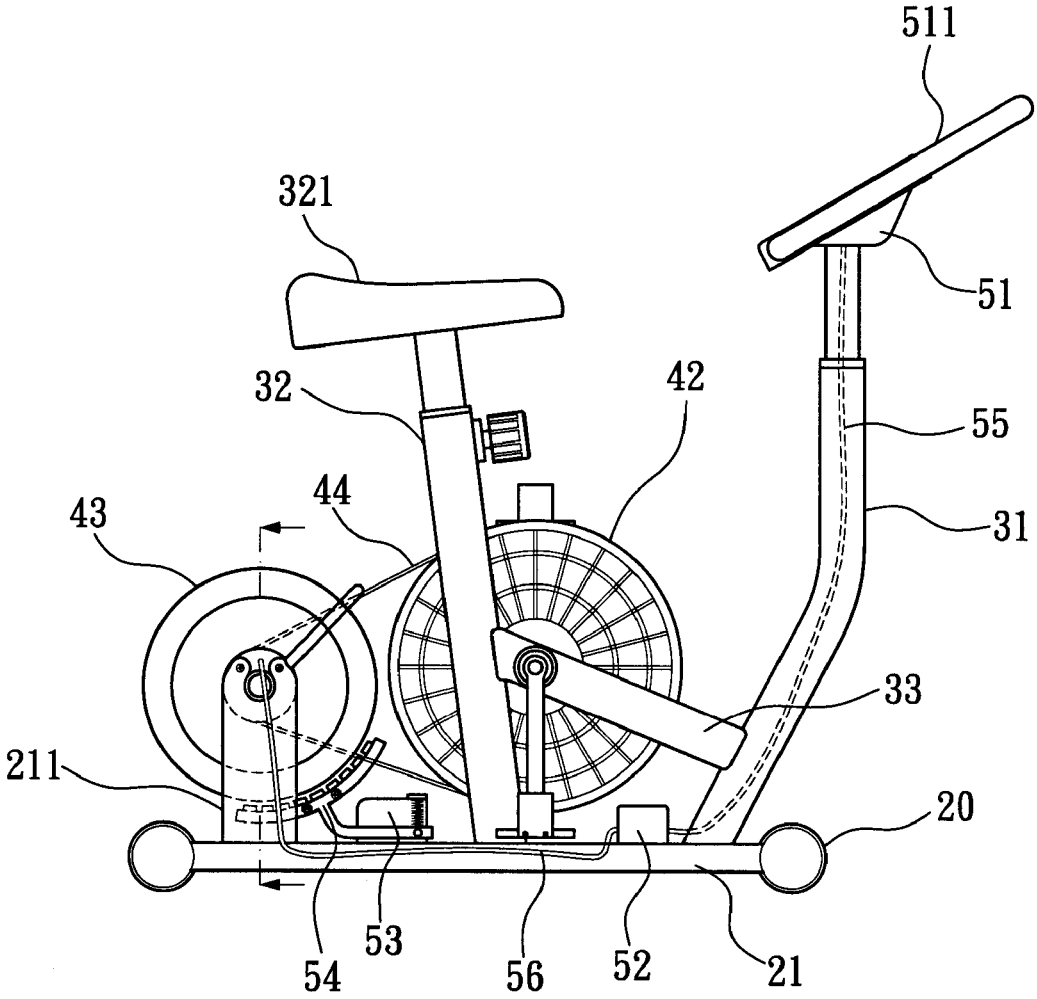
FIGS. 2 and 3 are a schematic view showing the operation of the present invention.
Figures 1, 2:
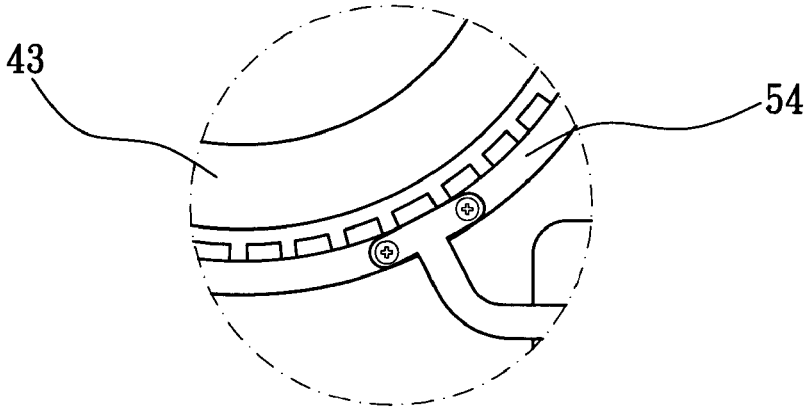

An electric control portion 50 has a control panel 51, a battery unit 52, a magnetic resisting unit 54, a displacement controller 53, a first electric wire 55 and a second electric wire 56. The control panel 51 is installed at a free end of the supporting rod 31. Each of two ends of the control panel 51 has a handle 511 attached thereto. The battery unit 52 is installed on the long central rod 21 between the supporting rod 31 and the seat rod 32. The battery unit 52 includes at least one cell. The battery unit 52 serves to store power from the flywheel 43 and provide electricity to the control panel 51. The magnetic resisting unit 54 is installed aside a wheel periphery of the flywheel 43 and the central shaft 432 of the flywheel 43. The displacement controller 53 serves to control the movement of the magnetic resisting unit 54 to move closer or away from the flywheel 43. The first elastic wire 55 is electrically connected to the battery unit 52 and the control panel 51 by passing through the supporting rod 31, as shown in FIGS. 1 and 2. The second electric wire 56 is installed between the power generator 431 and the battery unit 52.

The operation of the present invention is that as the user treads the treading portion 41; the treading portion 41 will drive the driving wheel 42. The rotation of the driving wheel 42 will transfer to the flywheel 43 through the driving belt 44. The rotation of the flywheel 43 will induce current in the power generator 431 and the current flows to the second electric wire 56. The current in the second electric wire 56 will flow to the battery unit 52.

Figure 3:
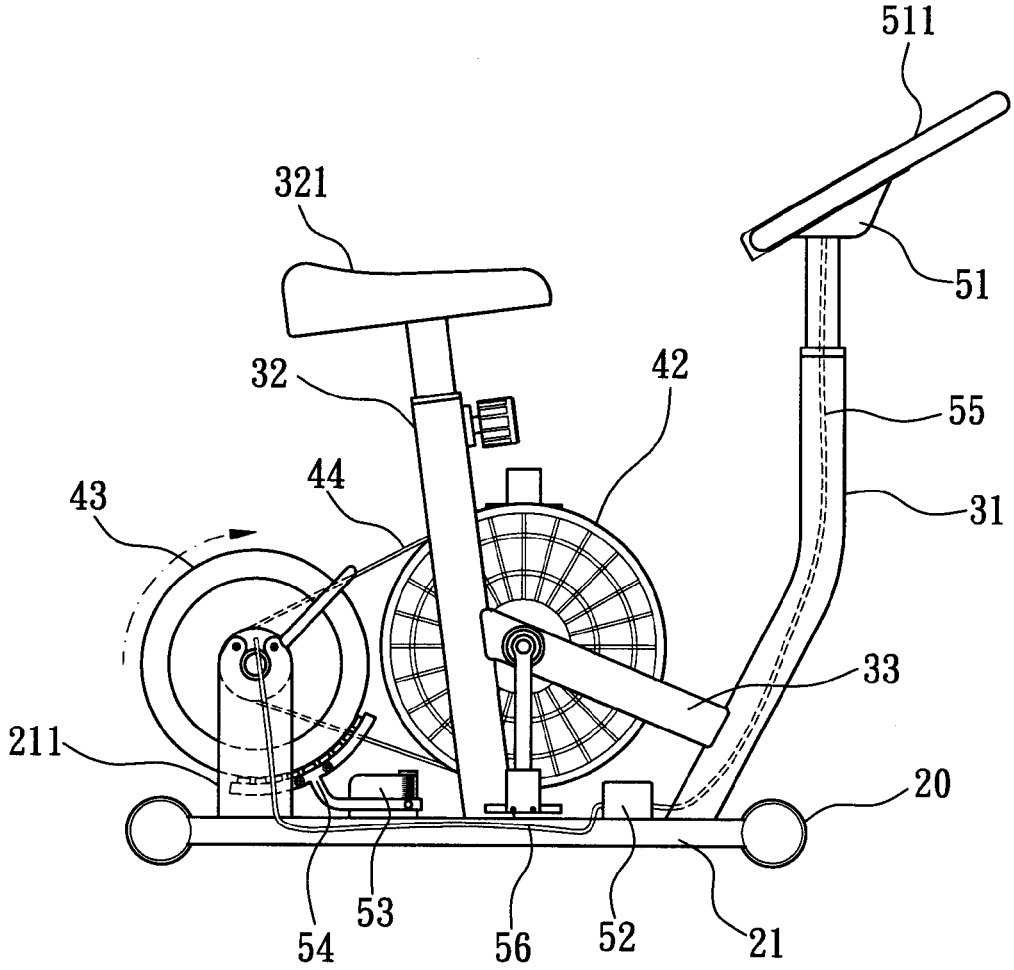
Figures 1, 3:
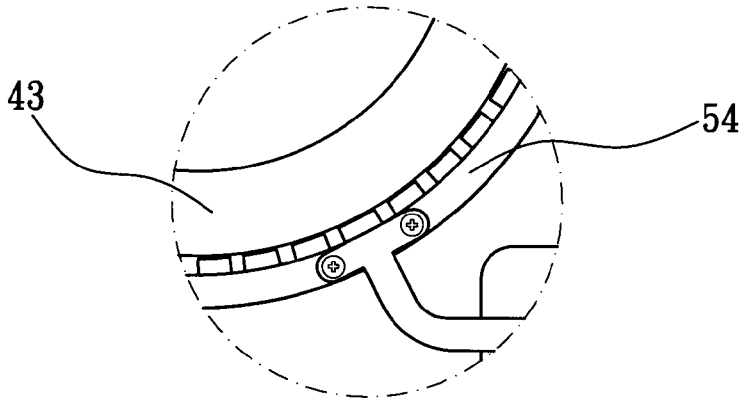

Referring to FIGS. 2 and 3, the control panel 51 drives the displacement controller 53 so as to displace the magnetic resisting unit 54 to move closer or away from the flywheel 43 so that the tension of the flywheel 43 is changed. Thus resisting forces to the flywheel 43 for different positions of the magnetic resisting unit 54 are different.

Figure 4:
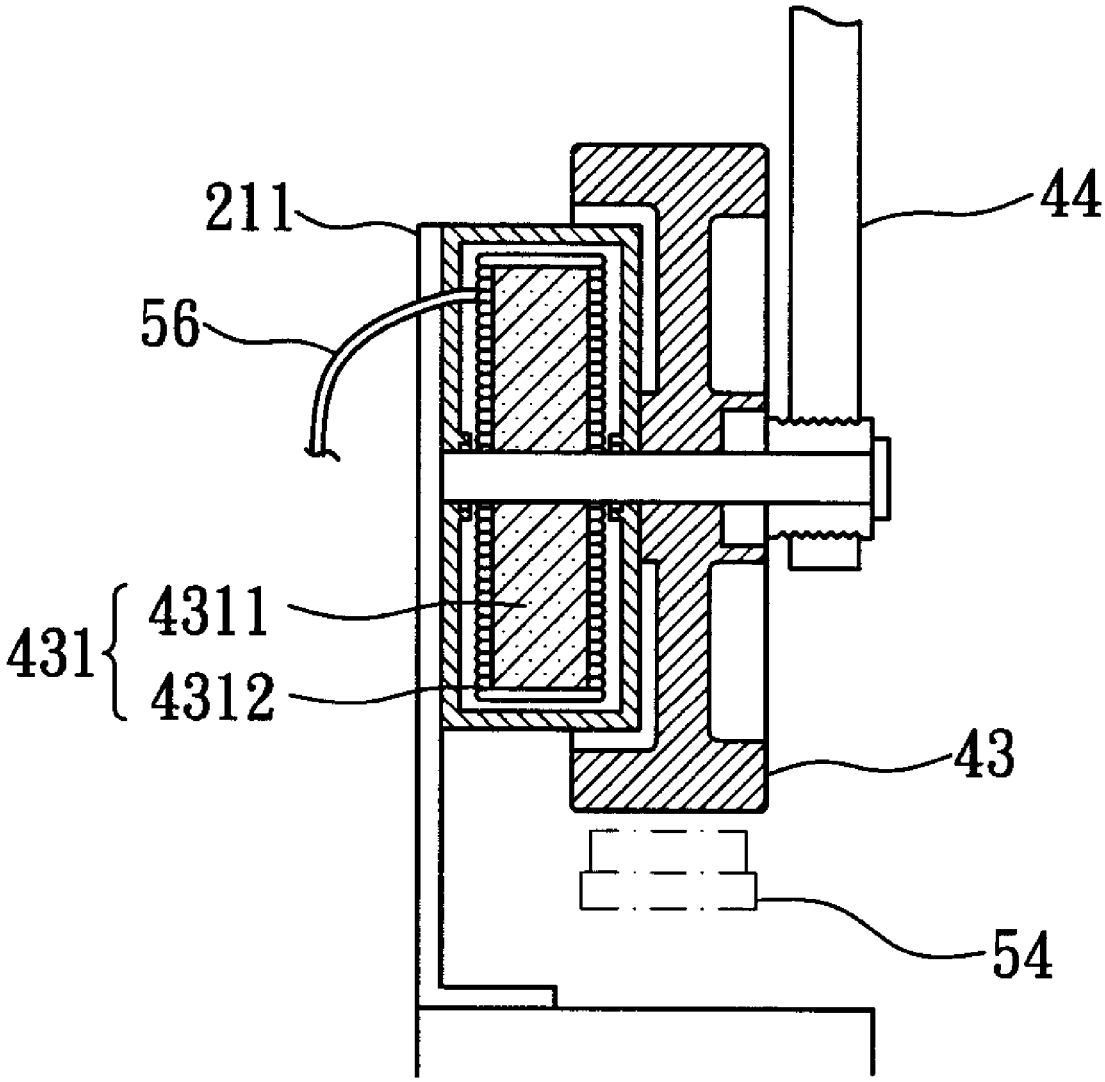
FIG. 4 is a cross sectional view of the body-training bicycle of the present invention.

Referring to FIG. 4, the power generator 431 has a magnetic unit 4311 which is moved coaxially with the flywheel 43. A periphery of the magnetic unit 4311 is installed with a plurality of magnetic coils 4312. One end of each coil 4312 is connected to the second electric wire 56 so that current will flow to the second electric wire 56 from the coil 4312.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A body-training bicycle, comprising:

an H-shaped seat having a long central rod;

a driving portion having a treading portion, a driving wheel connected to at least one treadle for driving the driving wheel, a flywheel and a driving belt; the flywheel being rotatable installed upon the seat; one side of the flywheel being installed with a power generator; the rotation of the flywheel will make the power generator generating power; the driving belt encircling around a center shaft of the flywheel and the driving wheel so that the rotation of the driving wheel will make the flywheel rotate and thus the power generator generates electric power;

an electric control portion having a control panel secured on a front portion of the H-shaped seat, a battery unit, a magnetic resisting unit, a displacement controller, and a first electric wire and a second electric wire; the battery unit secured on the seat for storing power from the flywheel and providing electricity to the control panel; the magnetic resisting unit being installed aside a periphery of the flywheel and the central shaft of the flywheel for providing damping to the flywheel; the displacement controller provided to control the movement of the magnetic resisting unit to move closer or away from the flywheel; the first electric wire electrically connected to the battery unit and the control panel; the second electric wire electrically connected to the power generator and the battery unit.

2. The body-training bicycle as claimed in claim 1, wherein a center of the driving wheel is connected to the treading portion so that the movement of the treading portion will drive the driving wheel.

3. The body-training bicycle as claimed in claim 1, wherein the power generator has a magnetic unit which is moved coaxially with the flywheel; a periphery of the magnetic unit in installed with a plurality of magnetic coils; one end of each of the magnetic coils connected to the second electric wire.

4. The body-training bicycle as claimed in claim 1, wherein a rear end of the central rod is formed with a wheel base for installing the flywheel.

5. The body-training bicycle as claimed in claim 1, wherein the battery unit contains at least one cell for storing electricity.

6. The body-training bicycle as claimed in claim 1, wherein the battery unit contains at least one capacitor for storing electricity.

* * * * *